United States Patent [19]

Bruns et al.

[11] Patent Number: 4,804,971

[45] Date of Patent: Feb. 14, 1989

[54] GUY SYSTEM FOR PARABOLIC REFLECTING ANTENNA

[75] Inventors: Robert W. Bruns; Douglas Kotval, both of Sunnyvale, Calif.

[73] Assignee: Chapparral Communications, San Jose, Calif.

[21] Appl. No.: 852,654

[22] Filed: Apr. 16, 1986

[51] Int. Cl.[4] ..... H01Q 19/12

[52] U.S. Cl. ..... 343/840; 343/834; 343/839

[58] Field of Search ..... 343/840, 834, 839

[56] References Cited

U.S. PATENT DOCUMENTS

| | | | |
|---|---|---|---|
| 2,846,678 | 8/1958 | Best | 343/840 |
| 2,945,233 | 7/1960 | Wild et al. | 343/840 |
| 3,276,022 | 9/1966 | Brunner | 343/840 |
| 3,530,476 | 9/1970 | Ravenscroft | 343/840 |
| 3,553,731 | 1/1971 | Szirtes | 343/839 |
| 3,618,111 | 11/1971 | Vaughan | 343/840 |
| 4,095,230 | 6/1978 | Salmond et al. | 343/840 |
| 4,538,175 | 8/1985 | Balbes et al. | 343/840 |
| 4,590,481 | 5/1986 | Burditt | 343/840 |

*Primary Examiner*—William L. Sikes
*Assistant Examiner*—Hoanganh Le
*Attorney, Agent, or Firm*—Lewis H. Eslinger

[57] ABSTRACT

A guy system is disclosed for a parabolic reflecting antenna having a reflecting surface and a signal receiver or feedhorn mounted at its focal point. A plurality of stays or guy wires is secured to the feedhorn, each of such guy wires extending through the reflecting surface to an anchor point behind the antenna substantially at or near its vertex. The resultant force acting on the antenna as a result of tension in the guy wires is thereby substantially tangential to the curvature of the reflecting surface.

16 Claims, 2 Drawing Sheets

GUY SYSTEM FOR PARABOLIC REFLECTING ANTENNA

FIELD OF THE INVENTION

The present invention relates to receiving antennas for high frequency, low energy microwave signals and, in particular, to a guy system for parabolic reflecting antennas employing a polarized signal receiver mounted at the focal point of the parabolic reflector. The signal receiver is stabilized by a guy system which is uniquely adapted to avoid any deformation of the reflecting surface as a result of tension in the system.

BACKGROUND OF THE INVENTION

Satellite earth receiving stations, or television receive only (TVRO) stations, have become enormously popular among the television consuming public in the past four to five years. Individuals, particularly those whose regular television reception is poor and for whom cable T.V. may not be available, have been installing such earth stations as the origination point for all of the iput signals to the television set. Earth stations are constructed so as to minimize interference from terrestrial microwave transmissions, some of which share the same 4-GHZ spectrum, and the receiving antennas must be situated so as to allow an unobstructed line of sight path to each of the desired satellites.

The largest component of the earth station is the receiving antenna which, in the case of home use, is a parabolic reflector or dish which may be from 4 feet to about 12 feet in diameter. The most popular dishes in the home market are from 6 feet to 12 feet in diameter. A waveguide or feedhorn is used to collect the signals at the focal point of the parabolic reflecting surface and to transmit them to a low noise pre-amplifier. Electronic processing, not a part of the present invention, is conventionally used to convert the signals to the different television channels.

In parabolic antennas from 6 feet to about 12 feet in diameter, the feedhorn is most often fixedly mounted at the end of a solitary support rod or arm, sometimes referred to as a buttonhook. The buttonhook extends axially outwardly from the concave side of the dish at its vertex for a predetermined distance such that the feedhorn it carries is situated precisely at the focal point of the reflector.

Where a buttonhook or similar type of support arm is used for the feedhorn, it is generally desirable to provide additional structural support for the feedhorn through the use of tensioned stays or guy wires. Guy wires are utilized to prevent the feedhorn from being swayed laterally or otherwise moved away from the focal point of the dish during periods of loads or stress on the dish, such as might be caused by wind, ice, snow or the like which have a tendency to deform, vibrate or otherwise adversely affect the stability of the structure. Any swaying or other movement induced in the buttonhook due to such stress can affect picture quality adversely. This is particularly true at the higher frequencies in the usual bands of operation.

Heretofore, structural support for the feedhorn has been provided through the use of a plurality of stays or guy wires which typically run from the feed itself to a point of termination at the peripheral edge of the parabolic dish. In a typical installation, there would be four such guy wires spaced apart by approximately 90°.

This prior arrangement has given rise to a number of problems and disadvantages. For example, many TVRO parabolic dishes are mounted at such a height that the upper most guy wire is often more than 10 feet above the ground. It is therefore difficult for an individual to access the connection point at the edge of the dish in order to adjust the tension in the guy wire. Even more significantly, since the guy wires must be taut in order to be effective, there is a tendency for such wires to induce a moment of force in the dish itself which causes the dish to deform inwardly toward the feedhorn. Any such deformation in the surface of the parabolic dish tends to alter the location of the focal point of the dish with devastating effects on picture quality. An additional disadvantage of the prior type of guy wire system is that the guy wires attached at the edge of the parabolic reflector tend to add structural support only to resist wind or other loads directed against the front or concave side of the reflector. Stress loads incident on the back of a dish having the prior type of guy wire system have a tendency to cause the wires to relax their tension thereby rendering them ineffective.

Other mounting techniques have been utilized heretofore in an effort to stabilize the position of the signal receiving feedhorn. For example, one prior type of arrangement includes the use of a tripod formed of rigid aluminum rods which are fixed to the feedhorn and bolted directly to the surface of the parabolic reflector. Such a tripod arrangement does not necessarily avoid deformation of the dish and it is not susceptible of adjustment after installation.

OBJECTS AND SUMMARY OF THE INVENTION

In accordance with the present invention, the foregoing disadvantages may be eliminated by providing support elements for the feedhorn, such as stays or guy wires, which are not attached to the peripheral edge of the parabolic dish but pass through the reflector surface to an attachment point at the back of the dish near the center. Although not critical, it is preferable that the guy wires pas through the dish at approximately two thirds of the radial distance from the center. In such an arrangement, the resultant moment of the forces applied to the dish when the supports or wires are at their proper tension lies substantially tangentially to the curvature of the dish thereby minimizing any tendency for the parabolic shape of the dish to deform. Where desired, turnbuckles can be provided near the point of attachment of the guy wires at the back of the dish in order to permit suitable adjustments to be made in the guy wire tension. In the usual installation, the center of the dish is only 5 or 6 feet from the ground and therefore adjustments may be easily made to the guy wires by the individual owners without the need for professional or other assistance.

An additional advantage of such a system is that the tension in such guy wires is unaffected by loads incident on the parabolic dish from either the concave or convex directions, i.e., either from the front or the back of the dish. The presence of such guy wires also serves to strengthen the dish against deforming under the incidence of such external loads.

As a result of the foregoing, it is one object of the present invention to provide a support system for the signal receiving feedhorn of a parabolic dish reflector which minimizes any tendency to deform the parabolic surface of the reflector when the support system is stressed to its operative tension.

Another object of the present invention is to provide a support system of the type described herein which effectively stabilizes the feedhorn at the focal point of the parabolic surface despite incident load stress on the dish.

Still another object of the present invention is to provide an easily adjustable support system for the signal receiving feedhorn of a parabolic dish antenna.

Yet another object of the present invention is to provide a support system for the signal receiving feedhorn of a parabolic dish which is unaffected by the presence of winds or other loads incident on the dish from either the front or the back of the dish.

A further object of the present invention is to provide a support system for the signal receiving feedhorn of a parabolic dish which strengthens the dish against deformation in the presence of external loads on the dish.

A still further object of the present invention is to provide a support system for the signal receiving feedhorn of a parabolic reflector in which the resultant force arising out of tension in the support system is directed generally tangentially to the curvature of the parabolic surface of the dish thereby minimizing any possibility of deformation of the dish.

BRIEF DESCRIPTION OF THE DRAWINGS

For a further understanding of the present invention, reference may be had to the accompanying drawings in which.

BRIEF DESCRIPTION OF THE PREFERRED EMBODIMENT

Figure 1:
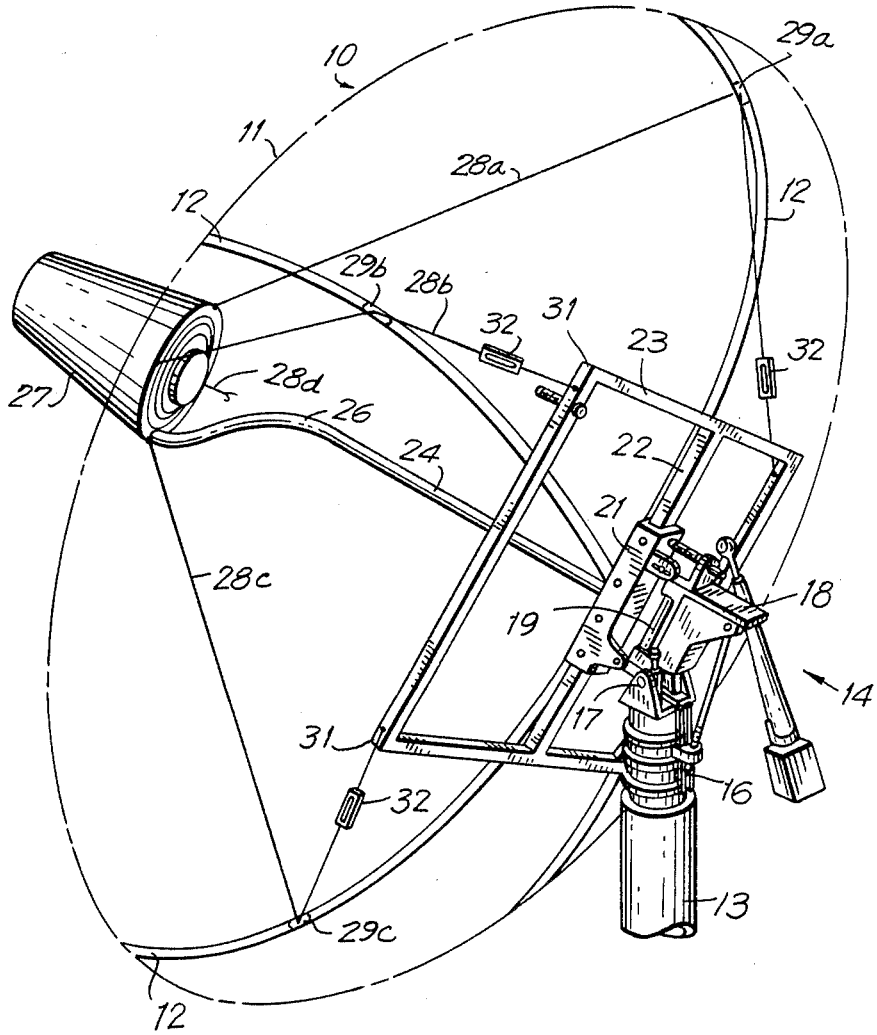
FIG. 1 is a perspective view from the back of a parabolic antenna dish shown in phantom and having the support or guy system of the present invention.

Referring now to the drawings, and in particular to FIG. 1, there is shown a parabolic reflector dish 10 of the type normally employed in connection with earth station reception for the TVRO market. The reflector is typically an axially symmetric reflector which forms a portion of a paraboloid including its vertex, generally indicated by reference numeral 11. Parabolic dishes of this type normally have a circular cross-section or periphery, although it is not essential that they take that form. For home earth stations, such reflectors may vary in size depending upon their location from about 6 feet in diameter up to approximately 12 feet in diameter. Larger parabolic dishes are known to exist for other uses. By far, the largest number of home use dishes sold are in the vicinity of 10 or 12 feet in diameter. Regardless of the overall size or peripheral shape of the reflector, it is essential that the reflecting surface constitutes a portion of a paraboloid so that it focuses microwave signals at a focal point.

The reflecting surface for the antenna dish may consist of an opaque sheet metal shell of microwave reflective material, such as aircraft aluminum. Alternatively, it may be preferred so as to resemble an ultra fine metal mesh which, because the perforations are small, reflects microwave energy but is not opaque to light.

Many such reflective dishes, regardless of whether they are opaque or perforated, are constructed with a plurality of bracing members or ribs 12 which may extend, as shown in FIG. 1, radially outwardly along the back surface of the dish from approximately the vertex of the paraboloid. Often, a network of supplemental ribs (not shown) extends across the main ribs in a variety of directions. The total number and configuration of the ribs, the material utilized for them as well as their dimensions can be selected by persons in the field to meet design criteria which are well understood and which do not form a part of the present invention.

Normally, the dish antenna is mounted at the end of a base post 13 which may be either embedded in a concrete pad formed in the earth or, depending upon the local antenna site, appropriately fastened at the top of the building. Because of the relatively large surface area of the parabolic reflector, the load which is transmitted to the base post can be large even in moderate winds. Accordingly, the the post itself must be sturdy. In addition, every effort is usually made to ensure that the post, as installed, is vertical.

In a typical installation, the post 13 is a pipe of approximately 4 inches outside diameter. It is installed in such a way that the upper end which carries the mount for the parabolic dish is situated approximately 4 to 5 feet above ground.

A pivot mount assembly, generally indicated by reference numeral 14, is provided to enable the antenna dish to be turned from one satellite to another, as desired, along the arc which defines the band of satellites in geosynchronous earth orbit. In general the pivot mount assembly may include a clamp formed by a pair of shells 16 which are fitted around and grip the top of the post 13. A pivot bolt 17 is suitably mounted at the top of the shells and defines the axis of North-South rotation around which the parabolic dish is rotated to adjust for the latitude of the site location. A transit bracket 18 carries the dish 10 and pivots on the bolt 17.

The transit bracket 18 includes a pivot shaft 19 which defines the East-West axis of rotation of the dish in tracking the satellite belt. A channeled support member 21 retains the center beam 22 of a substantially rectangular back-up support assembly 23 affixed to the dish 10. Different configurations may be utilized for the pivot mount assembly and the back-up support assembly without departing from the scope of the present invention.

A generally hollow support rod 24 is rigidly mounted at the vertex of the parabolic surface and extends axially outwardly a predetermined distance from the concave reflective surface of the dish. The rod 24 may take various configurations one of which includes a curved portion 26 defining what is commonly referred to as a buttonhook. The purpose of the buttonhook is to carry a signal receiver or feedhorn 27 in such a way that the feedhorn is situated precisely at the focal point of the parabolic reflective surface. In the preferred embodiment, the buttonhook is hollow in order to accommodate electrical wires which interconnect the feedhorn with other electrical components of the receiver system.

Figure 2:
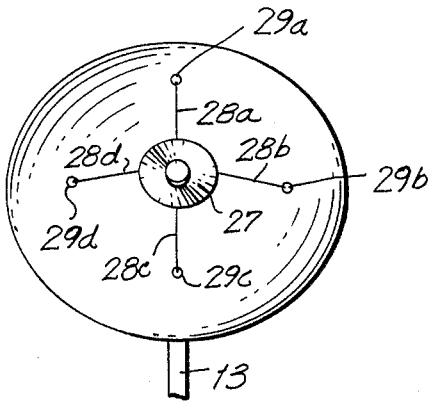
FIG. 2 is an elevational schematic view from the front of a parabolic dish in accordance with one embodiment of the present invention.

With reference to FIGS. 1 and 2, a plurality of support elements **28*a*–28*d* is provided to stabilize the feedhorn 27** relative to the focal point of the dish reflector surface. In the preferred embodiment, the support elements are guy wires, which may be made from a variety of suitable materials such as twisted or stranded steel cable including galvanized and stainless steel cable. Four such guy wires are shown, spaced apart by approximately 90° intervals. It should be understood however, that the invention is not to be limited by the type or number of stays or guy wires and it may be desirable under certain circumstances that one or more be eliminated or added without departing from the scope of the invention. Where three guy wires are employed, for example, they would preferably be situated at approximately 120° intervals.

In accordance with the invention, a plurality of apertures 29*a*–29*d* is provided in the reflector surface of the parabolic dish, one of each of the guy wires 28*a*–28*d*. The apertures are small holes in the dish, each of which may be situated approximately two thirds of the radial distance from the center of the dish to its peripheral edge. The distance of the holes 29*a*–29*d* from the dish center may be varied as desired. For dishes of about 10 to 12 feet in diameter, it has been found acceptable for the holes to be within the range of from about 3 feet from the dish center to about two thirds the distance to the dish periphery.

In the preferred embodiment, each hole is made at the location of and also extends through one of the main ribs running along the back of the dish. Each hole may, as desired, be reinforced by a conventional sleeve or grommet (not shown) which may, as desired, be made of aluminum, brass, high impact plastic, or plated non-corrosive steel including stainless steel. The forces exerted on the dish by the guy wires are transmitted to and absorbed by the main ribs and not by the relatively fragile material which forms the reflective body of the dish.

In an alternative embodiment (not shown), the apertures for the guy wires are not formed through the ribs but each is adjacent to a rib. Under such circumstances, each of the ribs carries or is formed with an appropriate guy wire support surface, which may be a ring or other protuberance, through or over which the guy wires pass or are strung, respectively.

After passing through the dish and rib, each guy wire extends substantially parallel to its associated rib and is fastened or anchored at the base of the dish, preferably at or near the vertex, in any suitable manner. Under preferred but not essential conditions, the segment of each guy wire in front of the dish and its segment behind the dish are disposed substantially in the same plane, which also includes at least a portion of the rib with which it cooperates.

As shown in FIGS. 1 and 2, the guy wires 28*a*–28*d* are anchored at or near the corners 31 of the back-up support assembly 23. This is for convenience only and is not to be deemed to limit the scope of the invention. The guy wires may, depending upon the structure of the dish, be fastened at the base of a rib or to some other firm structure near the vertex of the dish and will provide the same beneficial results. Indeed it is advantageous to anchor each guy wire as near to the vertex of the dish as is practical. In addition, it is important that the guy wires be anchored in such a way that they do not in any way interfere with the pivoting motion of the dish in normal operation.

A tension adjuster 32, which may be a conventional turnbuckle, is provided in each guy wire near the point that the guy wire is anchored at the back of the dish. This location of the turnbuckles is readily accessible for adjusting the tension in the guy wire under normal circumstances without the need for removing the dish from the base post or, in most cases, using a ladder.

Figure 3:
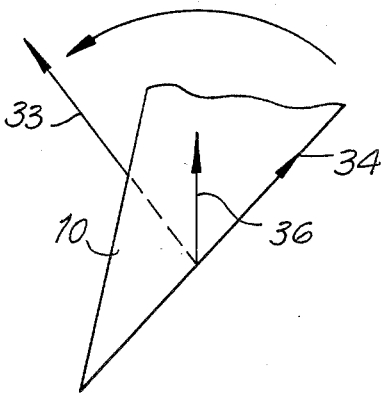
FIG. 3 is vector drawing showing the direction of the resultant force arising out of tension in the support system of the present invention.

With reference to FIG. 3, a force or vector diagram is shown which illustrates the distribution of forces achieved as a result of the guy wire configuration of the present invention. The direction of the force exerted on the dish 10 by the guy wire segment in front of the dish is indicated by reference numeral 33. The direction of the force exerted on the dish by the guy wire segment behind the dish is indicated by reference numeral 34. The resultant force is indicated by reference numeral 36. Since each taut guy wire passes through the dish and then extends along one of the ribs generally toward the center of the dish, the resultant force vector 36 acting on the dish itself is substantially tangent to the curvature of the reflector surface and, in particular, is absorbed by the rib in the direction of or along its length. Accordingly, the resultant force incident on the dish as a result of tension in the guy wires does not tend to induce substantial lateral deformation of the rib or the dish surface. The pressure on the rib exerted by the tension in the associated guy wire also tends to stabilize the dish structure to assist in resisting otherwise deforming stresses induced by wind, ice, snow or the like, irrespective of whether such stress is incident from in front of or behind the dish.

While the invention has been described in connection with a particular embodiment, it should be understood that various modifications may be made to the structure by those skilled in the art without departing from the scope of the present invention and that the inventive scope is limited only by the scope of the appended claims.

What is claimed is:

1. An antenna for receiving electromagnetic signals, comprising:

a signal reflector defined by a predetermined portion of a paraboloid, said reflector having a vertex and being formed with a plurality of apertures spaced radially from said vertex;

a signal receiver mounted at the focal point of signals reflected by said reflector; and a plurality of non-rigid support elements secured to said receiver and respectively passing freely through said apertures in said reflector to respective points of attachment on the side of said reflector opposite said receiver and near said vertex.

2. The antenna as set forth in claim 1 in which said reflector comprises a plurality of bracing members on the opposite side thereof from said receiver, each of said elements engaging one of a number of said members whereby the forces induced in the antenna by tension in said elements are transmitted to such members.

3. The antenna as set forth in claim 2 in which each of said apertures is formed adjacent one of said number of members.

4. The antenna as set forth in claim 3 in which each one of said number of members is provided with a supporting surface upon which one of said elements presses when tension is induced therein.

5. The antenna as set forth in claim 4 in which each of said supporting surfaces comprises a portion of the periphery of a guide aperture formed in one of said members.

6. The antenna as set forth in claim 5 in which the diameter of each said apertures is less than a wavelength of the electromagnetic signals.

7. The antenna as set forth in claim 6 in which said elements comprise guy wires.

8. The antenna as set forth in claim 2 in which the segments of each said elements on both sides of said reflector are disposed in substantially the same plane which includes at least a portion of one of said members.

9. The antenna as set forth in claim 1 in which the number of said elements is four.

10. The antenna as set forth in claim 1 in which the number of said elements is three.

11. The antenna as set forth in claim 1 comprising in addition means proximate to said point of attachment for adjusting the tension in each of said elements.

12. The antenna as set forth in claim 11 in which said tension adjusting means forms a part of each of said elements.

13. The antenna as set forth in claim 12 in which said tension adjusting means comprises a turnbuckle.

14. The antenna as set forth in claim 1 further comprising a back-up support assembly mounted in contact with said signal reflector on the side thereof opposite said signal receiver, whereby said respective points of attachment for said non-rigid support elements are arranged on said back-up support assembly.

15. The antenna as set forth in claim 14 in which said back-up support assembly is symmetrically arranged relative to the apex of said paraboloid signal reflector.

16. The antenna as set forth in claim 15 in which said back-up support assembly is rectangular and substantially smaller than said signal reflector.

* * * * *